United States Patent [19]

De Lima Castro Netto

[11] Patent Number: 4,512,599

[45] Date of Patent: Apr. 23, 1985

[54] SECURITY SEALING SYSTEM

[76] Inventor: Eduardo De Lima Castro Netto, Rua São Luiz Gonzaga, No. 912, Rio de Janeiro, Brazil

[21] Appl. No.: 456,898

[22] Filed: Jan. 10, 1983

[51] Int. Cl.[3] ..... B65D 33/34

[52] U.S. Cl. ..... 292/307 R; 24/388; 24/616

[58] Field of Search ..... 292/307, 327–330, 292/318–320, 325; 70/68; 24/573, 388, 435, 436, 614–616

[56] References Cited

U.S. PATENT DOCUMENTS

| | | | |
|---|---|---|---|
| 140,486 | 7/1873 | Dunn | 292/328 |
| 3,149,869 | 9/1964 | Chamberlin | 292/320 |
| 3,759,073 | 9/1973 | Rifkin | 70/68 |
| 4,008,914 | 2/1977 | Anderson | 292/307 R |
| 4,062,090 | 12/1977 | Moolenaars | 292/307 R X |
| 4,106,801 | 8/1978 | De Lima Castro Neto | 292/307 R |

FOREIGN PATENT DOCUMENTS

| | | | |
|---|---|---|---|
| 247175 | 5/1966 | Austria | 24/573 |

*Primary Examiner*—Gary L. Smith
*Assistant Examiner*—Russell W. Illich
*Attorney, Agent, or Firm*—Beveridge, DeGrandi and Weilacher

[57] ABSTRACT

There is described a security sealing system for selectively immobilizing two relatively movable parts, the system comprising a housing, a tunnel, into one end of which a seal element may enter, to latch resiliently with an insert which enters the tunnel from its other end. The device is applicable to postal envelopes, cabinets, freight containers etc.

7 Claims, 3 Drawing Figures

SECURITY SEALING SYSTEM

The present invention relates to security sealing systems, particularly to seals for envelopes used in sending valuables by post.

Currently available envelope seals suffer from disadvantage that their construction does not render the seal element completely inaccessible, and thus the possibility exists that a tool may be used to manipulate the seal to release it.

The present invention seeks to provide a construction for an envelope seal in which a resilient plastics seal element retains the slider of a zip-type fastener in its closed position, the seal element being rendered inviolable by being closely received within a housing.

Preferably the device comprises three parts; the housing, a seal receptor element attached to the slider of a sliding zip-type fastener and a resilient seal element of the type described in our Brazilian Pat. No. 7501943.

A security sealing system for a linear sliding closure includes a housing, an insert member, and a seal member. The housing is provided with a linear passage which extends in a first direction and has an open first end and an open second end. The insert member has a leading end which is insertable in a first direction into the first end of the linear passage. The configuration of the insert member is such that it fills the passage at the first end thereof. The insert member is provided with first abutment means for closing the first end of the passage and for preventing the insert member from passing through the passage. The seal member is insertable into the second end of the passage in a direction parallel to and opposite from the first direction. The seal member includes a resilient detent, a second abutment means facing the detent, and a frangible section positioned between the detent and the second abutment means. The insert member has a cavity for receiving and containing the detent of the seal member when the insert and seal member are within the passage and the first and second abutment means are engaged with the ends of the passage. The cavity of the insert member has internal surfaces which are cooperable with the detent of the seal member to resist separation of the insert and seal members.

Two embodiments of the present invention will now be described with reference to the accompanying drawings, in which.

Figure 1:
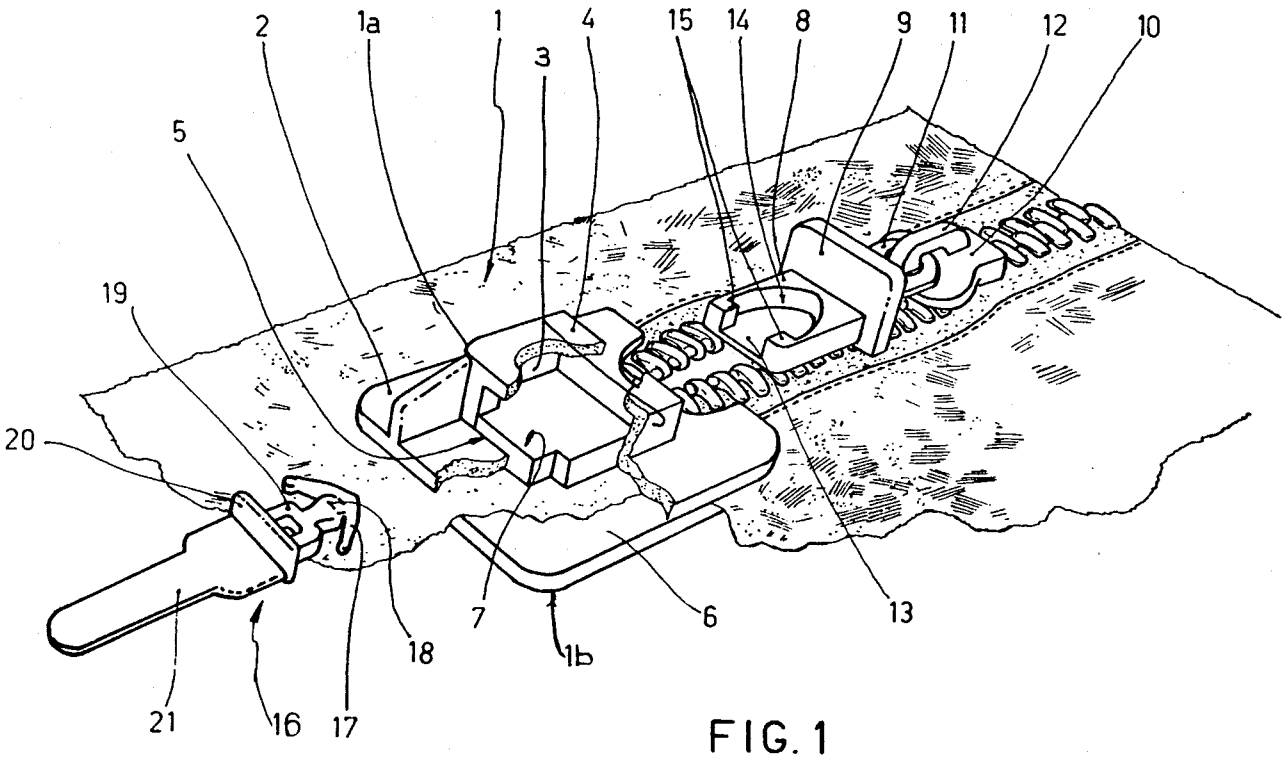
FIG. 1 is a cutaway perspective view of a first embodiment of the device applied to a "zip" fastener.

As can be seen from FIG. 1, the device comprises a two-piece housing 1, comprising upper part 1*a* and lower part 1*b*.

Upper part 1*a* comprises a generally rectangular flange 2, in the centre of which is formed a tunnel comprising sidewalls 3 and a roof 4. The tunnel is open at both of its ends, the opening at one end being wider than that the other in the embodiment shown. The flange 2 has an aperture 5, extending between the sidewalls 3 and the openings of the tunnel.

The lower part 1*b* comprises a plate 6 of a size and shape substantially equal to flange 2 of upper part 1*a*, and a raised central area 7 which corresponds in shape and size to the aperture 5 of the upper part 1*a*.

In use in an envelope having an opening which is closeable by a zip-fastener, the two series of teeth which comprise the zip are attached to the sides of the opening leaving a small space at one end of the opening. At the other end of the fastener the series of teeth are fastened together and to the envelope material.

The lower part 1*b* of the housing 1 is then placed within the envelope so that the raised part 7 lies between the free ends of the teeth of the zip and the one end of the opening.

The upper part 1*a* of the housing is then placed over the lower part 1*b*, so that the raised area 7 enters the aperture 5, and the envelope material is trapped between the flange 2 and the plate 6. The flange 2 and plate 6 are then permanently fixed together, for example by welding. To assist in this, the flange and plate may be provided with cooperating formations such as projections and apertures, the projections penetrating the envelope fabric and entering the apertures, to be secured therein.

The housing thus provides a tunnel, accessible only from its ends, the axis of the tunnel aligned with the zip-fastener.

To the slider of the zip-fastener is attached an insert comprising a drawer-like element 8 capable of being slidingly received within the tunnel, and closely fitting therewithin. At the end of the drawer element 8 nearest to the slider 10 is a blanking wall 9, which serves to close completely the end of the tunnel when the drawer 8 is therewithin.

A tongue 11, perforated near its free end, extends from the side of wall 9 of remote drawer 8, and allows slider 10 to be attached to drawer element 8 by means of a hook 12 provided on the slider 10.

The drawer element 8 is formed with an open end 13, remote from wall 9, which open end allowes access to a cavity 14. Within the cavity 14, detent surfaces 15 are positioned on either side of opening 13, the detent surfaces facing the interior of the cavity towards wall 9. In the embodiment shown, the cavity is open at its end and also at one side, being formed as a depression in the drawer element 8, for ease of moulding.

When the zip is in its closed position, with the slider 10 adjacent the housing 1, the drawer may be inserted into the tunnel so that wall 9 prevents access to one end thereof, and at the other end of the tunnel opening 13 of the drawer element is aligned with the other open end of the tunnel.

To seal the zip closed, a frangible seal 16 is inserted into the tunnel from the said other end. The seal includes a resilient arcuate nose 17, joined by a frangible section 18 to a body 19, to which is attached an abutment or fence 20. To the fence 20 is attached an elongated flattened strip 21, which may bear identifying marks, letter or numbers.

The arcuate nose 17 of the seal is resiliently flexed as it passes through the open end of the tunnel and the opening 13, and once inside the cavity regains its original form so that the ends of the nose 17 are situated adjacent the detent surfaces 15 within the cavity. The seal cannot then be withdrawn without breaking the frangible section 18.

The seal 16, tunnel and drawer 8 are so dimensioned that the body 19 of the seal completely fills both the opening 13 in the drawer 8, and the open end of the tunnel remote from the zip. Also, the fence 20 is held tightly against the end of the tunnel to prevent access to the interlocked parts.

To open the sealed envelope, the strip 21 is grasped and pulled, to break the frangible section 18. This allows the remainder of the seal to be withdrawn, leaving the nose part 17 within cavity 14. The drawer 8 may then be withdrawn from the tunnel by sliding the slider 10 to open the zip. The open-topped configuration of the drawer allows easy removal of the detached nose 17 whereupon the device is ready for re-use with a fresh seal 16.

Figure 2:
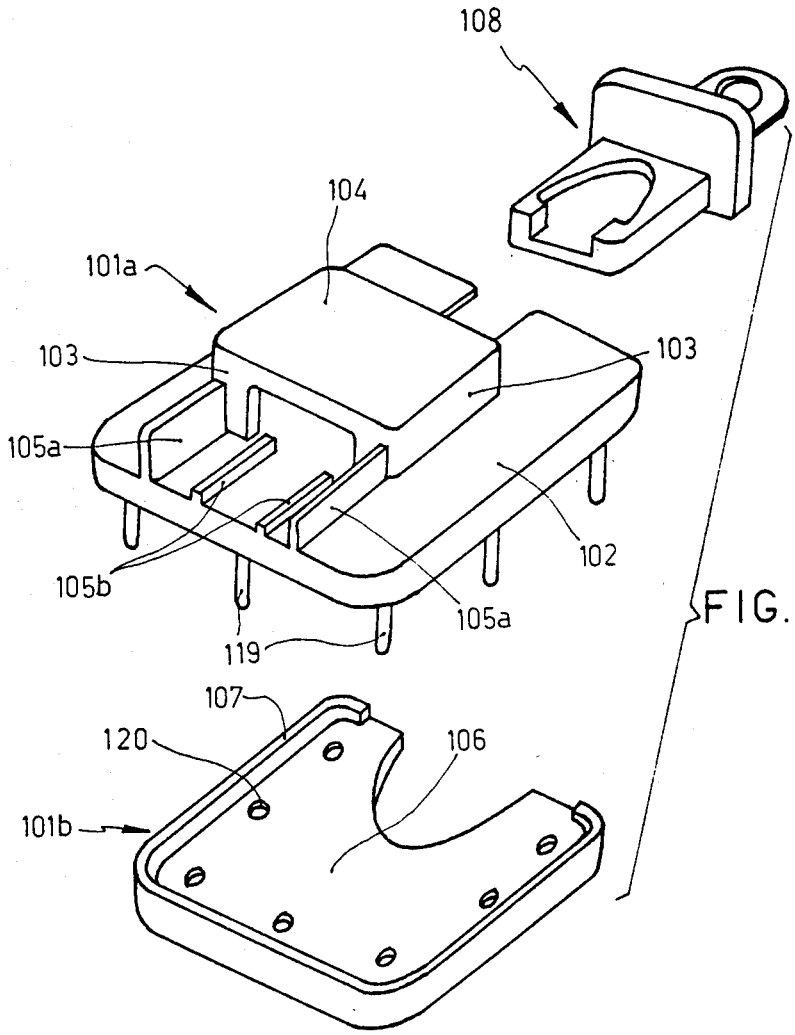
FIG. 2 is an exploded perspective view of a second embodiment of the device.
Figure 3:
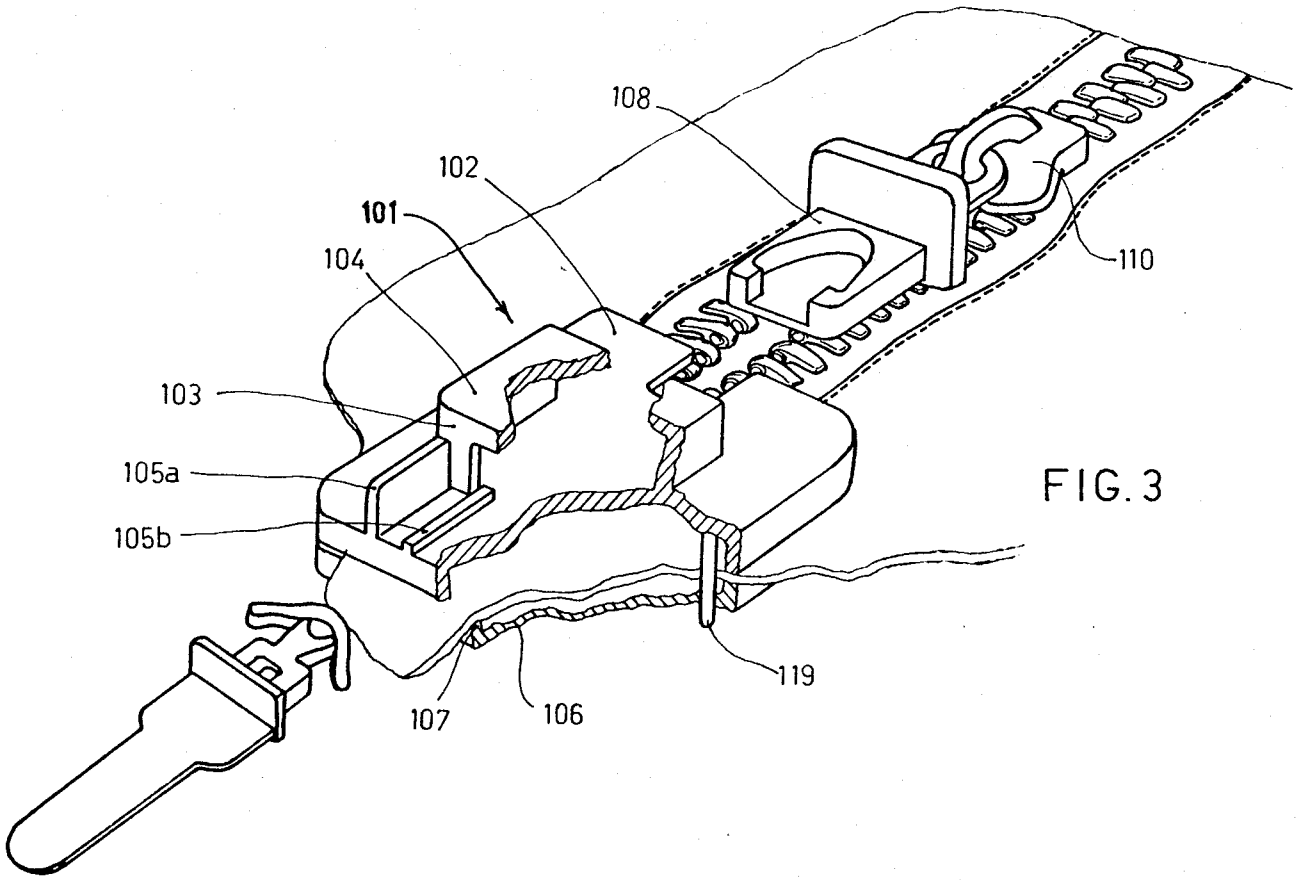
FIG. 3 is a cutaway perspective view, similar to FIG. 1, showing the second embodiment.

Referring now to FIGS. 2 and 3, there is shown a second embodiment of the invention, in which the housing has been changed in certain details, but the action of which is as described previously.

The housing 101 comprises an upper part 101*a* and a lower part 101*b*, both of generally rectangular configuration.

Upper housing part 101*a* comprises an imperforate flange 102, in the centre of which is formed a tunnel comprising sidewalls 103 and roof 104. The tunnel has open ends, and adjacent that end of the tunnel which receives the seal 116 are formed guide walls 105*a* and ribs 105*b*.

The lower part of housing 101*b* comprises a simple plate 106, having an upstanding peripheral lip 107, and apertures 120 to receive legs 119 which extend from the flange 102 of the upper housing part 101*a* for fixing the two parts together. Cutaway areas in both the flange 102 and the plate 106 allow the slider 110 of the zip fastener to approach more closely the housing 101 when seal receptor 108 is inserted into the tunnel of upper housing part 101*a*.

The seal receptor 108 may have the same configuration as previously described, or may simply take the form of two parallel arms having spaced, rearwardly facing detent surfaces between their free ends. The cavity sould then be defined by roof 104, flange 102, and the adjacent side faces of the arms of the insert element.

Clearly the device is applicable to sealing zip fasteners in particular, but may be adapted without difficulty to other applications where two relatively movable parts require selective immobilization, such as medicine cabinet doors, freight containers, etc. Clearly, the device will not prevent such movable parts from being moved, but will provide a clear indication that opening has taken place, thus preventing undetected movement.

The security of the device may be improved if the cavity 14 in drawer 8 is open downwardly rather than upwardly as shown in figure.

The device clearly is capable of being simply and economically formed of plastics material. Embodiments are evisaged wherein the housing and drawer are transparent, or the housing is transparent and a window is formed in the drawer or vice versa, to permit visual inspection of the frangible section 18 of the seal.

I claim:

1. A security sealing system for a linear sliding closure, said system including a housing having a linear passage extending in a first direction, said passage having a first end which is open and a second end which is open, an insert member having a leading end which is insertable in a first direction into the first end of the linear passage, said insert member having a configurartion which substantially fills said passage at said first end thereof, first abutment means on the insert member for preventing the insert member from passing through said passage and for closing said first end of said passage, a seal member which is insertable into the second end of the passage in a direction parallel to and opposite from said first direction; said seal member including a resilient detent, a second abutment means facing the detent, and a frangible section positioned between the detent and the second abutment means; said insert member having a cavity for receiving and containing the detent of the seal member when the insert and seal member are within the passage and the first and second abutment means are engaged with the ends of the passage, said cavity having internal surfaces therewithin which are cooperable with said detent of the seal member to resist separation of the insert and seal members.

2. A security sealing system according to claim 1, wherein the insert member comprises a leading end portion of generally rectangular cross-section, said recess being open at the leading end and at one lateral face of the insert member.

3. A security sealing system according to claim 1, wherein the insert member has a trailing end which is a perforated tongue for attachment to a slider of a zip fastener.

4. A security sealing system according to claim 1, wherein the housing includes superposed upper and lower flanges for fixing the housing to a flexible sheet material by interposing part of the material between the flanges.

5. A security sealing system according to claim 4, wherein the upper flange has, on its side remote from the lower flange, two upstanding parallel sidewalls and a roof.

6. A security sealing system according to claim 5, in which the linear passage is defined by the sidewalls, the roof, and part of the upper flange.

7. A security sealing system according to claim 5, in which the upper flange has an aperture formed therein, and said lower flange has a raised part extending into said aperture; said linear passage being formed by the sidewalls, the roof, and the raised part of the lower flange.

* * * * *